US006835062B2

(12) United States Patent
Mitchell et al.

(10) Patent No.: US 6,835,062 B2
(45) Date of Patent: Dec. 28, 2004

(54) FUEL OIL SUPPLY CIRCUIT FOR AN OIL BURNER HAVING A SOLENOID VALVE IN PARALLEL CIRCUIT WITH DIAPHRAGM VALVE FOR CONTROLLING OIL FLOW AT START UP

(75) Inventors: Bill Mitchell, Rockford, IL (US); David Zierke, Rockford, IL (US); Dale L. Hunsberger, Rockford, IL (US)

(73) Assignee: Suntec Industries Incorporated, Glasgow, KY (US)

( * ) Notice: Subject to any disclaimer, the term of this patent is extended or adjusted under 35 U.S.C. 154(b) by 170 days.

(21) Appl. No.: 10/017,153

(22) Filed: Dec. 14, 2001

(65) Prior Publication Data

US 2003/0113676 A1 Jun. 19, 2003

(51) Int. Cl.[7] ..... F23N 5/00

(52) U.S. Cl. ..... 431/29; 431/62; 431/89; 137/115.01

(58) Field of Search ..... 431/29, 30, 62, 431/6, 90, 89; 137/115.01, 115.06, 115.13; 417/299; 239/127, 126

(56) References Cited

U.S. PATENT DOCUMENTS

| | | | | |
|---|---|---|---|---|
| 3,566,901 A | | 3/1971 | Swedberg | |
| 4,392,810 A | * | 7/1983 | Bears et al. | 431/37 |
| 4,544,349 A | * | 10/1985 | Nakamura et al. | 431/30 |
| 4,626,194 A | * | 12/1986 | Mills | 431/90 |
| 5,145,328 A | | 9/1992 | Harwath | |
| 5,339,636 A | * | 8/1994 | Donnelly et al. | 60/39.281 |
| 5,346,174 A | | 9/1994 | Harwath | |
| 5,368,068 A | | 11/1994 | Hunsberger et al. | |
| 5,448,882 A | * | 9/1995 | Dyer et al. | 60/39.281 |
| 5,458,294 A | * | 10/1995 | Zachary et al. | 431/80 |
| 5,692,679 A | * | 12/1997 | Marran et al. | 239/127 |
| 5,692,680 A | | 12/1997 | Harwath et al. | |

FOREIGN PATENT DOCUMENTS

| | | | | |
|---|---|---|---|---|
| GB | 2 099 130 A | * | 12/1982 | F23N/5/00 |
| JP | 2-13707 A | * | 1/1990 | |

OTHER PUBLICATIONS

Suntec Industries, Inc. Model A 70 Fuel Unit drawing; prior to Nov. 28, 2001;1 page.

SUNTEC Model A–7400 Fuel Unit Solenoid Dumping Pump drawing; prior to Nov. 28, 2001; 2 pages.

SUNTEC Model A–2100 Fuel Unit Line Blocking Solenoid Pump drawing; prior to Nov. 28, 2001; 1 page.

* cited by examiner

*Primary Examiner*—Josiah C. Cocks
(74) *Attorney, Agent, or Firm*—Leydig, Voit & Mayer, Ltd.

(57) ABSTRACT

A fuel oil supply circuit that includes two bypass mechanisms for burner startup including an electrical valve bypass in parallel circuit with a mechanical valve bypass. The fuel oil supply circuit includes an oil pump that is adapted to pressurize fuel oil and a downstream regulating valve assembly that is adapted to regulate pressurized fuel flow to the nozzles of the burner. A solenoid valve controls flow of pressurized fuel oil through the regulating valve assembly to the nozzles. The solenoid valve has a first state keeping the regulating valve assembly closed, and a second state allowing the regulating valve assembly to open. A diaphragm valve is fluidically connected to the pump in parallel circuit with the regulating piston assembly to provide an alternative bypass mechanism as a backup for the electrical solenoid valve.

18 Claims, 4 Drawing Sheets

FUEL OIL SUPPLY CIRCUIT FOR AN OIL BURNER HAVING A SOLENOID VALVE IN PARALLEL CIRCUIT WITH DIAPHRAGM VALVE FOR CONTROLLING OIL FLOW AT START UP

FIELD OF THE INVENTION

The present invention relates generally to oil burners, and more particularly relates to valve mechanisms for controlling oil flow upon start up and shut down of oil burners.

BACKGROUND OF THE INVENTION

Oil burner units have in the past been provided with regulating valves interposed between the nozzles or nozzle which discharge fuel into the combustion chamber and the fuel pump which supplies fuel oil to the nozzles. Generally, these regulating valves open upon delivery of a predetermined supply pressure from the pump, regulate a substantially constant pressure flow to the burner nozzles, and shut off the supply of fuel oil to the nozzles when the pump is turned off upon shut down. In addition to regulating the pressure of fuel oil delivered to the burner nozzles, these valves often have a bypass function of diverting an excess portion of the fuel oil pressurized and delivered by the pump back to the tank or pump reservoir so that only a portion of the fuel oil supplied by the pump is delivered to the nozzles.

One of the problems that has been dealt with in the past is that transient variations in the fuel oil discharge from the nozzles at startup and/or shutdown cause highly undesirable smoking and soot production in the combustion chamber at these times. One known attempt of remedying this problem has been to arrange a mechanical valve bypass, which typically comprises a diaphragm valve (typically in association with a cone valve) downstream of the fuel pump. For example, mechanical valve bypass mechanisms are shown in U.S. Pat. No. 5,692,680 to Harwath, U.S. Pat. No. 5,145,328 to Harwath, and U.S. Pat. No. 3,566,901 to Swedberg, the entire disclosures of these patents are hereby incorporated by reference. This mechanical valve bypass has an open position that returns fuel oil to the tank or pump reservoir (typically through the diaphragm valve) for moments directly after burner startup and upon loss of pressure upon shut down. When sufficient pressure is present, the mechanical valve bypass closes and fuel is allowed to flow through the regulating valve to the nozzles for combustion.

Although the mechanical valve bypass (e.g. the diaphragm valve) has provided acceptable results with respect to reducing most soot production and smoking in the combustion chamber, there is still some smoking and soot production with this approach. This is due to the fact that the blower of the burner is not fully up to speed when the diaphragm valve closes and fuel oil is ported to the nozzles. A good draft up the chimney is also not established at this point. A less than desirable fuel to air ratio still exists momentarily upon start up using the combination of the cone valve and the diaphragm valve.

Attempts have been made to overcome the drawbacks of mechanical valve bypass mechanisms and to provide for longer fuel oil bypass time periods at burner start up. Specifically, according to some fuel oil supply circuits, the mechanical valve bypasses have been eliminated and replaced with electrical control devices such as solenoid valves, which either block flow or bypass flow through the regulating valves to prevent the regulating valves from opening. This prevents flow to the burner nozzles upon startup. For example, fuel pump units according to this fuel circuit arrangement are commercially available from the present assignee, Suntec Industries, Inc. and sold under SUNTEC MODEL A-7400 FUEL UNIT, SUNTEC MODEL B-8400 FUEL UNIT and SUNTEC MODEL A-2100 FUEL UNIT. With electrical control, it is known to provide the solenoid devices with a thermistor that delays movement of the solenoid valve and thereby prevents the opening of the regulator valve. Longer times periods and hence better control can be achieved with thermistor operated solenoid valves over mechanical valve bypasses.

It is also known to use electronic control over the solenoid instead of thermistors to control opening of the regulating valve. The solenoid valve can be controlled directly by the burner control. This provides more precise or exact control over the opening and closing of the regulating valve and thereby provides better results. One problem that can occur with electrical solenoid valves is that improper installation or incompatible electrical set ups can cause failure of the solenoid to delay fuel oil flow to the nozzles upon burner start up. Improper installation can thus cause the regulating valve to open immediately upon burner start up and thereby result in undesirable smoking and soot production in the combustion chamber.

BRIEF SUMMARY OF THE INVENTION

In view of the foregoing it is a primary objective of the present invention to provide a fuel oil supply circuit for an oil burner that more reliably prevents smoking and/or soot production upon burner start up and/or shutdown.

In accordance with these and other objectives, the present invention is directed toward a fuel oil supply circuit that includes two mechanisms for preventing fuel flows to nozzles at burner startup including an electrical control or solenoid valve in parallel circuit with a mechanical valve bypass. The provision of two mechanisms arranged such that one backs up the other better ensures that smoking and soot production is maintained at acceptable levels in the burner, even if for example, the electrical system fails or is improperly installed.

According to disclosed embodiments of the present invention, the fuel oil supply circuit includes an oil pump that is adapted to pressurize fuel oil and a downstream regulating valve assembly that is adapted to regulate pressurized fuel flow to the nozzles of the burner. The regulating valve assembly has an inlet receiving the pressurized fuel oil and an outlet port connected with the nozzles. A solenoid valve controls flow of pressurized fuel oil through the regulating valve assembly to the nozzles. The solenoid valve has a first state keeping the regulating valve assembly closed, and a second state allowing the regulating valve assembly to open. A diaphragm valve is fluidically connected to the pump in parallel circuit with the regulating piston assembly to provide a backup for the solenoid valve. The diaphragm valve has a first position allowing flow of pressurized oil through a return to the fuel supply and a second position forcing oil to flow to the regulating valve assembly.

According to one embodiment of the present invention the solenoid valve bypasses fuel through a return passage leading back to the fuel supply while in the first state. This causes the fuel pressure to stay sufficiently low in the regulating valve assembly such that the regulating valve is kept closed under the force of a spring.

According to another embodiment of the present invention, the solenoid valve blocks fuel flow and prevents fuel from flowing through an outlet port of the regulating valve assembly. This keeps the regulating valve assembly closed.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1A:
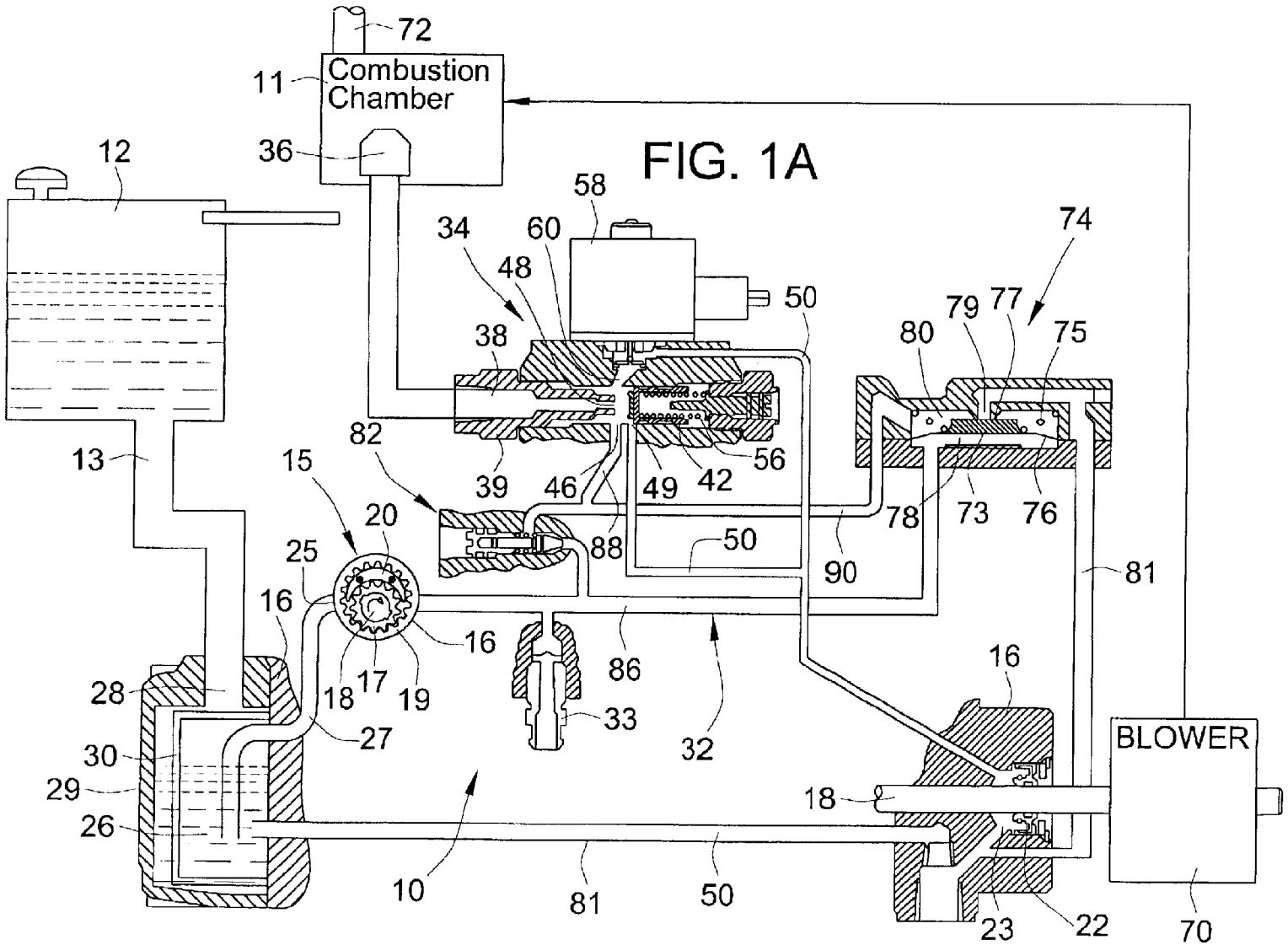
FIG. 1A is a schematic representation of a new and improved oil pumping system according to a first embodiment of the present invention illustrated under normal burner operating conditions.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

As shown in the drawings for purposes of illustration, the invention is embodied in a fuel oil supply circuit 10 of the type used to supply fuel to the combustion chamber 11 of an oil burner such as might be incorporated into a furnace or boiler. The circuit 10 includes a pump 15 that draws fuel oil from an oil supply such as a tank 12 through an intake line 13.

The pump 15 includes a body or housing 16 and may be of the crescent gear type. An inner gear 17 within the housing is attached to a drive shaft 18 and is eccentrically disposed with respect to an outer gear 19. A crescent-shaped member 20 is disposed between the non-engaging portions of the teeth on the gears for the purpose of sealing the expanding fluid chambers defined by the gears from the contracting fluid chambers in a well known manner.

The pump shaft 18 is journaled in the housing 16 and is sealed with respect thereto by an elastomeric sealing member which herein is shown in the form of a lip seal 22. The lip seal 22 is disposed within and seals off a lubrication chamber 23 in the housing.

The pump 15 may communicate with a local fuel oil supply or reservoir 26 that receives fuel oil from the main oil supply or tank 12. The pump 15 includes a pump inlet 25 that is connected by an inlet passage 27 in the housing to the reservoir 26. The reservoir 26 is defined by an end cover 29 bolted to one end of the housing 16 and has an intake port 28 to which the intake line 13 is connected. A suitable strainer 30 located within the reservoir 26 between the intake port 28 and the pump inlet 25 serves to filter the fuel oil as it is drawn from the tank to the pump 15. The pump 15 pressurizes the fuel oil and outputs fuel into a supply passage 32. A bleed valve 33 may be disposed along the supply passage 32. The supply passage 32 ultimately delivers fuel oil to a main regulating valve assembly 34 that serves to regulate the pressure of fuel oil and causes fuel flow to nozzles 36 to be of a substantially constant pressure.

Herein, the regulating valve assembly 34 is located in the housing 16 and serves to control the fuel flow from the supply passage 32 to a nozzle passageway 38 that leads to the nozzles 36. The nozzle passageway 38 is formed partly through a fitting 39 threaded into the housing 16. The fitting 38 has a projection that defines a valve seat 40 that is adapted to be closed by a hollow piston 42. The piston 42 is slidably mounted in a pressure chamber 44 and regulates fuel flow entering the chamber 44 through an inlet port 46. Specifically, the piston 42 controls the flow of fuel entering the inlet port 46 to an outlet port 48 and a return port 49 that leads to a low pressure return passage 50 back to the pump reservoir 26 (or alternatively to the tank 12). The piston 42 includes a land 52 between ends that regulates fuel flow to the return port 49 and return passage 50. The return passage 50 may pass through the lubrication chamber 23 so as to lubricate the drive shaft 18 and lip seal 22. The forward end or disc face 54 of the piston 44 is adapted to engage the valve seat 40 and close the outlet port 48 and nozzle passageway 38. A coil spring 56 tends to keep the piston 42 in the closed position and seated against the valve seat 40. A spring adjustment mechanism 57 may be provided to control and adjust the biasing force exerted by the spring 56.

A solenoid valve 58 controls opening of the regulating valve assembly 34 upon startup and may control closing of the regulating valve assembly 34 upon shut down. The solenoid valve 58 regulates flow through a bypass port 60 that connects with the pressure chamber 44 of the regulating valve assembly 34. The bypass port 60 drains to the return passage 50 leading back to the pump reservoir 26. The solenoid valve 58 drives a movable valve element 62 between two states that open or close an opening 63 through a valve seat 64. The valve seat 64 is situated in the bypass port 60 such that the solenoid valve element 62 can open and close the bypass port 60. The solenoid valve 58 includes an electrical control element 66 for driving the valve element 62 with electrical lead wires 68 that may connect with the burner control (not shown) or electrical circuit of the shaft motor (not shown) for the drive shaft 18.

Figure 1B:
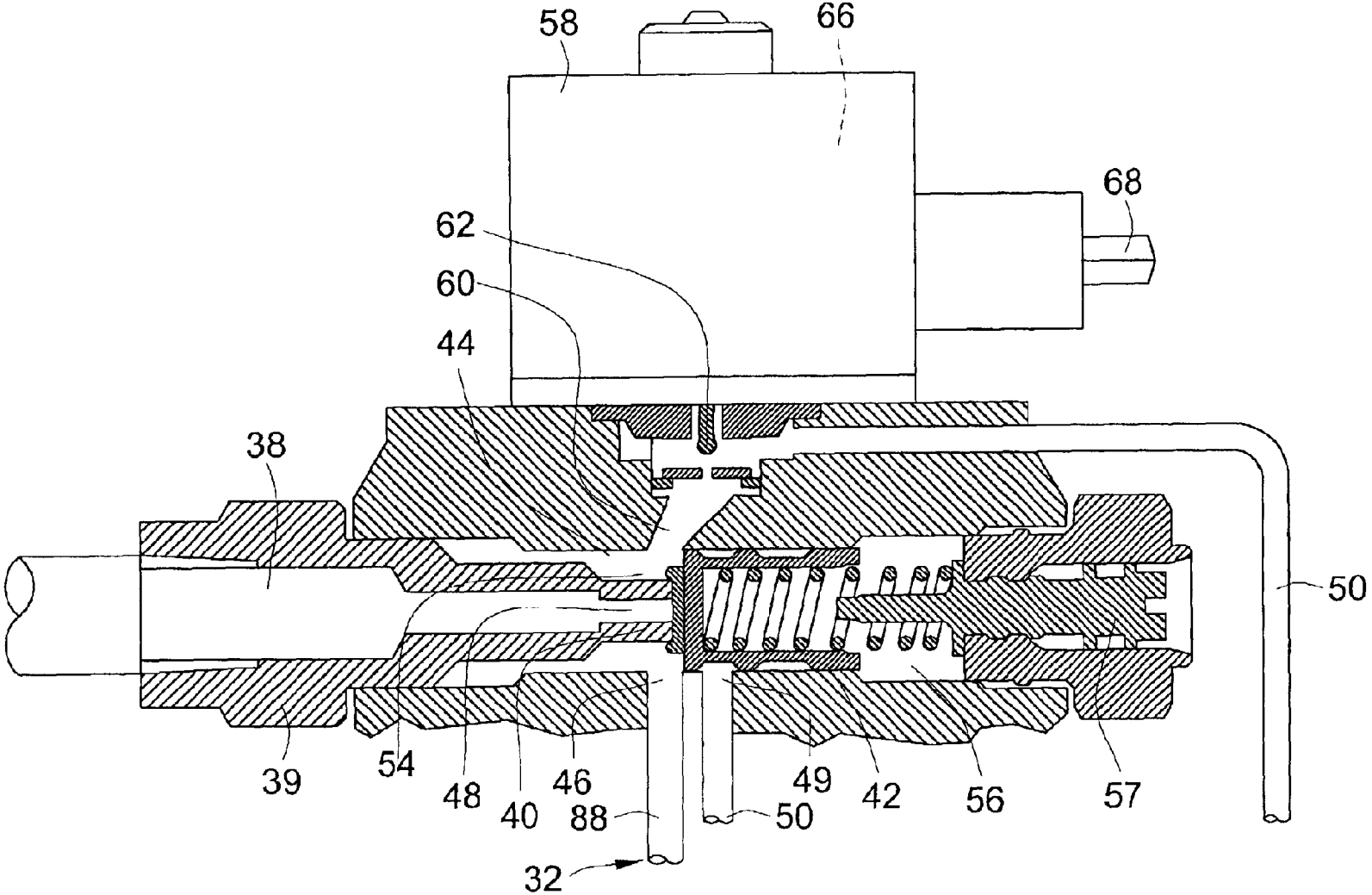
FIG. 1B is an enlarged view of the regulating valve assembly and solenoid control valve shown in FIG. 1A, illustrated in a different state at start up.

The solenoid valve 58 includes an open state as shown in FIG. 1B, wherein the fuel oil is bypassed through the bypass port 60 and return passage 50. This reduces pressure in the pressure chamber 44 sufficiently such that the regulating valve assembly 34 is kept closed under the action of the spring 56. The solenoid valve 58 also includes a closed state as shown in FIG. 1A in which fuel pressure may build in the pressure chamber 44 and cause the piston member 42 to be lifted off of its seat 40 to allow fuel to flow through the nozzle passageway 38. While in this state shown in FIG. 1A, any excess fuel will cause the piston 42 to slide even further causing the return port 49 to open partially to allow excess fuel to drain and be recycled back to the pump reservoir 26. This allows fuel flow and pressure through the nozzle passageway 38 to be substantially constant.

The electrical control element 66 may include a thermistor providing a desired time delay for switching the solenoid valve between states. Alternatively, the electronic control (not shown) for the burner may provide the means to control activation of the solenoid control element. In either event, a delay is typically provided in order to provide sufficiently high pump speed and fuel pressure; and also to allow the speed of the blower 70 (which is driven by the same shaft 18 as the pump 15) to be sufficient to establish a good draft up the chimney 72 of the burner.

In accordance with the invention, a second mechanical bypass mechanism shown herein as a diaphragm valve 74 is arranged in parallel circuit with the first bypass mechanism of the solenoid valve 58 and/or the regulating valve assembly 34. The diaphragm valve 74 causes the pump 15 to reach a high start-up rpm before the regulating valve assembly 34 opens and causes the regulating valve assembly 34 to close after the pump 15 falls below a certain rpm upon shutdown. The diaphragm valve 74 includes a resilient diaphragm 76 located within a chamber and dividing the chamber into two compartments 78, 80. The resilient diaphragm 76 carries a valve member 73 within the second compartment 80. A spring 75 biases the valve member 74 toward an open position. The valve member 73 is adapted to engage a valve seat 77 which includes an return outlet 79 to a return passage 81 leading back to the pump reservoir 26 (or alternatively to the tank 12). The first compartment 78 directly communicates with the outlet pressure of the pump 15. However, the second compartment 80 is subjected to a reduced pressure along the supply passage 32 caused by a restricting valve shown herein as a cone valve 82.

The cone valve 82 provides for a pressure drop along the supply passage 32 and thereby divides the supply passage 32 into an upstream segment 86 and a downstream segment that is comprised of a first branch passage 88 to the inlet port 46 of the regulating valve assembly 34 and a second branch passage 90 to the second compartment 80 of the diaphragm valve 74.

With the foregoing arrangement, the spring 75 normally holds the valve member 73 of the diaphragm valve 74 in an open position with respect to the return outlet 79. When the pump 15 is started, fuel oil from the pump 15 is supplied to the first compartment 78 of the valve 74 through the upstream segment 86 of the supply passage 32. Fuel oil is also supplied to the second compartment 80 of the valve 74 through the cone valve 82 by way of the second downstream branch passage 90. During start-up when the pump 15 is at relatively low speed, the flow past the cone valve 82 is relatively low and thus the differential between the pressure the compartments 78, 80 is insufficient to overcome the spring 75 and close the valve member 73 with respect to the return outlet 79. As a result, fuel delivered to the second compartment 80 flows through the return outlet 79 and along the return passage 81 to the pump reservoir 26.

As long as the speed of the pump 15 is relatively low, the valve member 73 of the diaphragm valve 74 remains open and prevents a build up of pressure in the chamber 44 of the regulating valve assembly 34 sufficiently such that the regulating valve assembly 34 remains closed. However, as the pump speed increases, the increased flow past the cone valve 82 causes the pressure differential between the compartments 78, 80 to increase sufficiently such that the pressure in the first compartment 78 overcomes the combined force of the pressure in the second compartment 80 and spring 75 to close the valve member 75 against the seat 77 and thereby close return flow through the return outlet 79. This allows for sufficient pressure to build in the regulating valve assembly 34 (assuming the solenoid valve closes) such that the regulating valve assembly 34 can open and fuel oil can be delivered to the nozzles 36 for combustion in the combustion chamber 11.

The diaphragm valve 74 acts as a back up for the solenoid valve 58 and better ensures that smoking or soot production does not occur in the combustion chamber 11. The regulating valve assembly 34 remains closed as long as either the diaphragm valve 74 remains open or the solenoid valve 58 remains open. The regulating valve assembly 34 opens only after the diaphragm valve 74 closes and the solenoid valve 58 closes. Because the diaphragm valve 74 is sensitive to pressure and hence pump speed, and the solenoid valve 58 is responsive to electronic signals or a time delay period, different parameters are utilized to control opening of the regulating valve assembly. For example, if the solenoid valve 34 is hooked up incorrectly, is stuck closed, or if the pump does not come up to sufficient speed within the allotted delay time, the regulating valve assembly 34 will not open prematurely and cause substantial smoking and soot production in the combustion chamber 11 due to the diaphragm valve 74. Thus, under preferred settings, the regulating valve assembly 34 will not open or deliver fuel to the nozzles 36 until a specified pre-purge time has elapsed and the pump has reached its full speed.

Figure 2A:
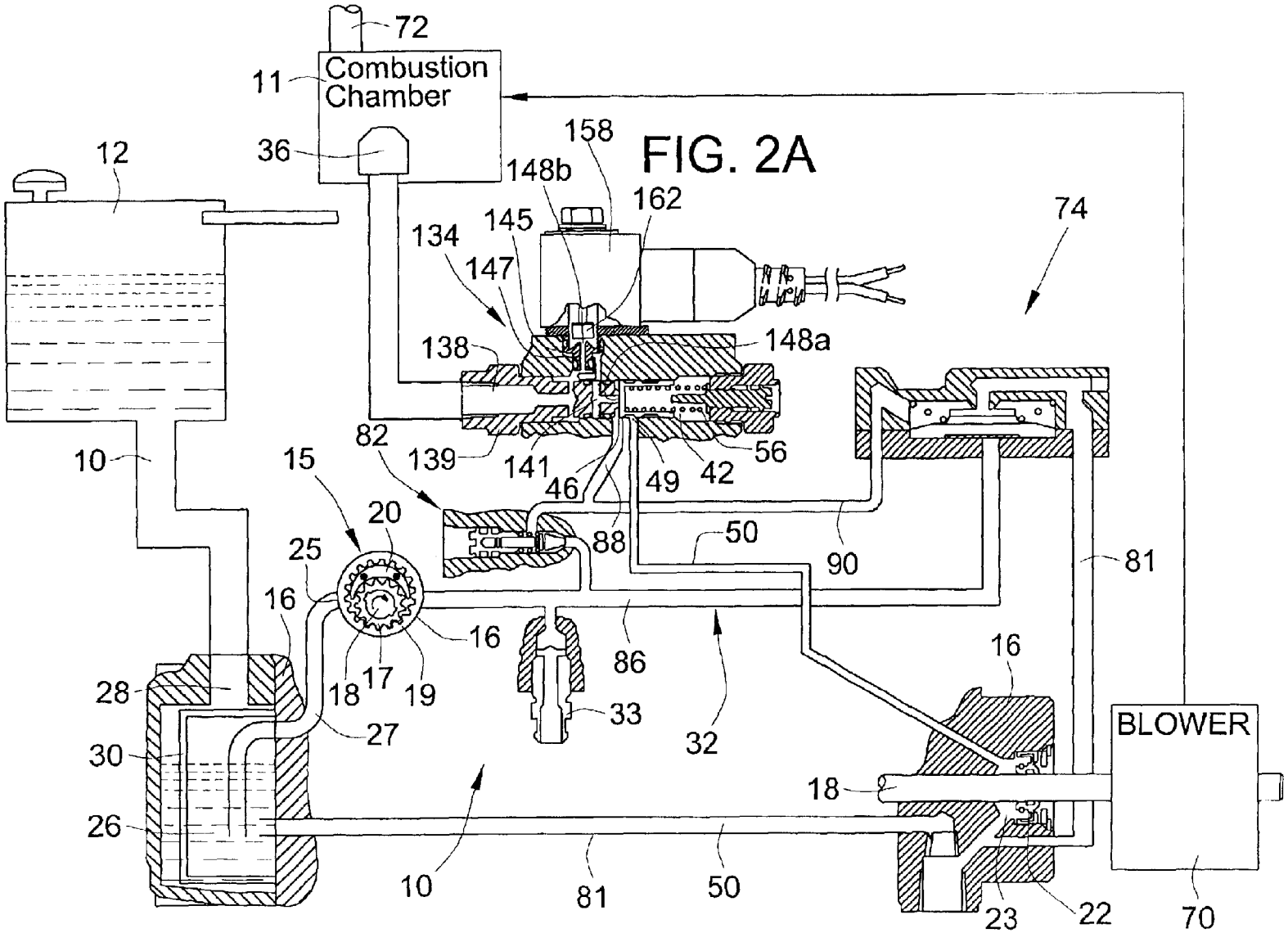
FIG. 2A is a schematic representation of a new and improved oil pumping system according to a second embodiment of the present invention illustrated under normal burner operating conditions.
Figure 2B:
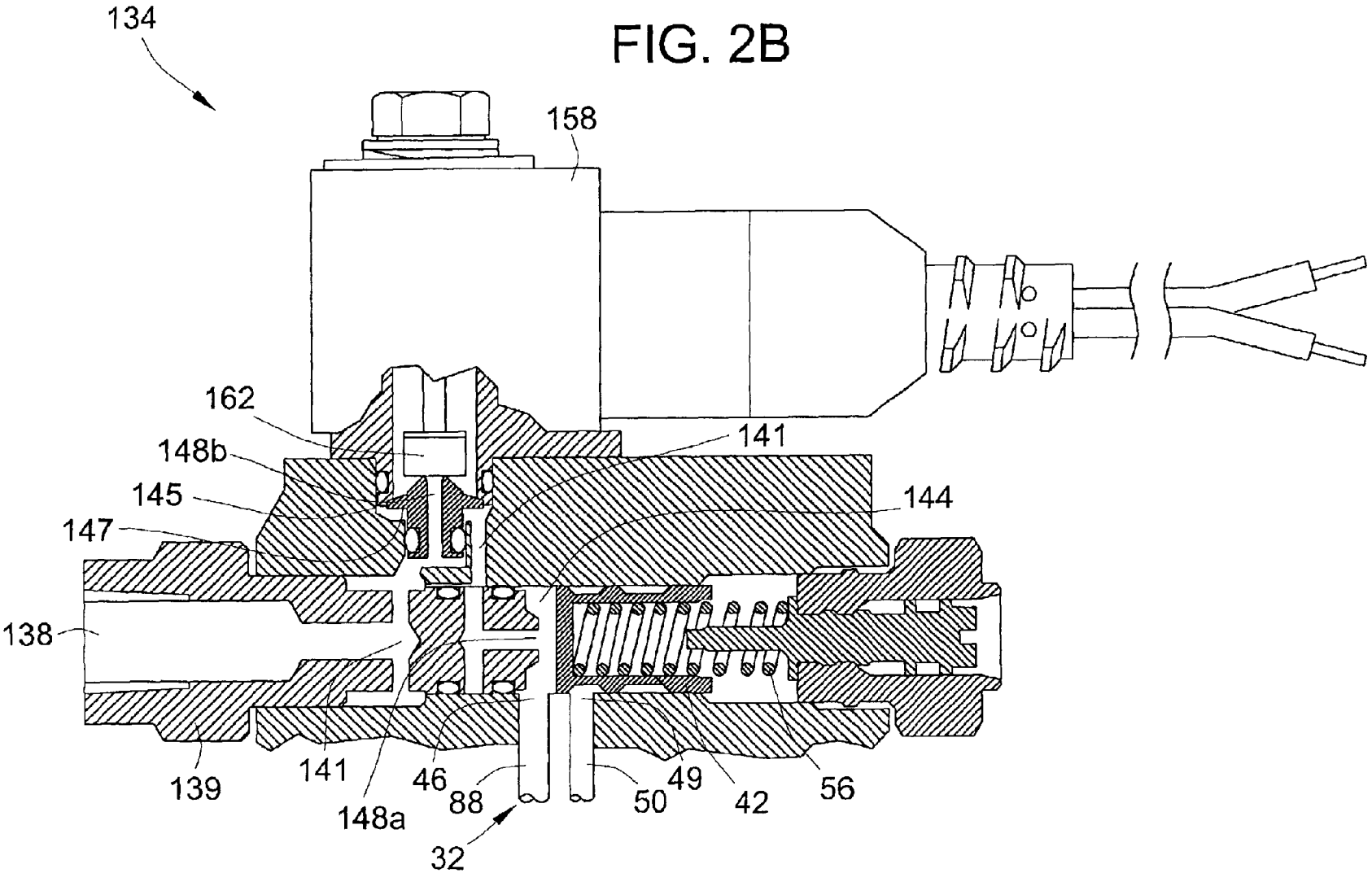
FIG. 2B is an enlarged view of the regulating valve assembly and solenoid control valve shown in FIG. 2A, illustrated in a different state at start up.

Turning to FIGS. 2A and 2B, an alternative embodiment of the present invention has been illustrated which is similar to the first embodiment except for the configuration of the regulating valve assembly 134 and the solenoid valve 158. Because of the similarities, the same reference numbers have been used for like components in FIGS. 2A and 2B, except for those components which are materially different which have been to the extent possible referenced with similar characters that are greater in value by 100.

In the second embodiment, the solenoid valve 158 does not bypass flow during startup but instead selectively blocks the flow from entering the nozzle passage 138 and thereby blocks fuel flow to the combustion chamber 11. This embodiment includes a different type of nozzle fitting 139 threaded into the regulating valve assembly 134. The nozzle fitting 139 includes an intermediate passage 141 connected to the pressure chamber 144 which is adapted to be closed at one end by the piston 42 and at the other end by a valve element 162 of the solenoid valve 158. The intermediate passage 141 extends partly through an end portion of the fitting 139 and up into a receptacle opening 145 that receives the solenoid valve 158. A valve seat insert 147 is mounted in the receptacle opening 145 for cooperation with the solenoid valve 158. This arrangement provides the regulating valve assembly 134 with two separate outlet ports 148A and 148B through which fuel oil must pass to reach the nozzle passageway 138. The piston 42 continues to be biased by the spring 56 to close the first outlet port 148A. The solenoid valve element 162 is adapted to close the second outlet port 148B of the regulating valve assembly 134.

In operation, as long as the diaphragm valve 74 is open and the pump speed is below a predetermined level, the piston 42 of the regulating valve assembly 134 remains closed at the first outlet port 148A (regardless of whether the second outlet port is open), and hence the regulating valve assembly 134 remains closed. Once the diaphragm valve 74 closes, the piston 42 of the regulating valve assembly 134 is lifted off of its seat which opens the first outlet port 148A. However, the regulating valve assembly 134 may still remain closed and fuel is still not permitted to flow through the nozzle passage 138 by virtue of the solenoid valve 158 blocking the second outlet port 148B. Typically, the diaphragm valve will close very rapidly within a couple of seconds after burner start up and therefore the solenoid valve 158 continues to block the second outlet port 148B and keep the regulating valve assembly closed for several seconds thereafter even though the piston 42 is lifted off of its seat and the assembly 134 is regulating the fuel oil pressure. During this time, fuel may be bypassed through the excess fuel return port 49, where it is recirculated back to the pump reservoir 26 or tank 12. With sufficient pressure lifting the piston 42 off its seat and once the solenoid valve 158 switches states and opens as shown in FIG. 2A, the regulating valve assembly 134 opens and allows fuel oil to be supplied through the nozzle passageway 138 to the nozzle 36. If insufficient pressure is present in the pressure chamber 144 to open the first outlet port 148A when the solenoid valve 158 opens the second port 148B, the regulating valve assembly 134 remains closed. However, at this point the solenoid valve 158 having opened the second port 148B allows the regulating valve assembly 134 to open automatically upon sufficient pressure being generated and received in the pressure chamber 144.

In the second embodiment, the diaphragm valve 74 is hooked up in parallel circuit with the regulating valve assembly 134 and operates in the same manner as in the first embodiment. Thus, the diaphragm valve advantageously serves to back up the operation of the solenoid valve 158. If the solenoid valve 158 is hooked up incorrectly to open upon start up or is otherwise stuck open, most smoking and soot production will be prevented in the combustion chamber 11 by virtue of the flow being bypassed through the diaphragm valve 74 which keeps the first outlet port 148A of the regulating valve assembly 134 closed.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fuel oil supply circuit for supplying fuel oil to a nozzle in an oil burner, comprising:

an oil pump connected to a fuel supply and adapted to provide pressurized fuel oil;

a regulating valve assembly having an inlet port receiving the pressurized fuel oil and an outlet port connected with the nozzle, the regulating valve assembly having open and closed positions allowing and preventing flow of the pressurized fuel oil between inlet and outlet ports, respectively;

a solenoid valve controlling flow of pressurized fuel oil through the regulating valve assembly, the solenoid valve having a first state keeping the regulating valve assembly closed and a second state allowing the regulating valve assembly to open; and a diaphragm valve fluidically connected to the pump in parallel circuit with the regulating valve assembly, the diaphragm valve having a first position allowing flow of pressurized oil through a return to the fuel supply and a second position forcing oil to flow to the regulating valve assembly, wherein in the event of premature opening of the regulating valve assembly the solenoid valve, the diaphragm valve operate at startup preventing premature output of oil, and wherein the diaphragm valve closes when the pump reaches a predetermined speed, and wherein the solenoid valve allows the regulating valve assembly to open after a predetermined time, the regulating valve assembly staying closed until the pump reaches the predetermined speed and the predetermined time has elapsed.

2. The fuel oil supply circuit of claim 1, further comprising a fuel supply passage between the oil pump and the regulating valve assembly further comprising a restricting valve interposed along the fuel supply passage dividing the fuel supply passage into upstream and downstream passages, the restricting valve adapted to provide a pressure drop from the upstream passage to the downstream passage.

3. The fuel oil supply circuit of claim 2 wherein the downstream passage includes a first branch to the regulating valve assembly and a second branch to the diaphragm valve, the upstream passage acting on the diaphragm valve opposite fluid pressure contained in the second branch, the diaphragm valve being spring biased to an open position in which the second branch is fluidically connected to the return leading to the fuel supply and closing in response to sufficient pressure in the upstream passage.

4. The fuel oil supply circuit of claim 3 wherein the regulating valve assembly comprises a piston and a spring, the spring acting on the piston tending to keep the regulating valve assembly closed, the regulating valve assembly adapted to open a passage leading to the nozzle via pressurized fuel oil acting upon a face of the piston against the action of the spring.

5. The fuel oil supply circuit of claim 4 wherein the solenoid valve while in the first state bypasses fuel oil through the return to the fuel supply.

6. The fuel oil supply circuit of claim 1 wherein the solenoid valve includes a valve element that while in the first state blocks pressurized oil from flowing to through the outlet port and while in the second state opens the outlet port.

7. The fuel oil supply circuit of claim 1 wherein upon startup of the burner, the diaphragm valve closes to second position before the solenoid valve allows the regulating valve assembly to open.

8. The fuel oil supply circuit of claim 1 wherein the solenoid valve includes a thermistor providing delayed activation of the solenoid.

9. The fuel oil supply circuit of claim 1 wherein the solenoid valve is electronically controlled by a electronic controller of the burner.

10. A fuel oil supply circuit for supplying fuel oil to a nozzle in a oil burner, comprising:

an oil pump adapted to pressurize fuel oil;

an oil regulator regulating pressurized fuel oil from the oil pump to the nozzle;

an electrical control for the oil regulator, the electrical control adapted to prevent pressurized fuel flow to the nozzle upon startup of the burner and allow pressurized fuel flow to the nozzle after startup of the burner; and a valve bypass in parallel circuit with the oil regulator responsive to oil pressure of the pressurized fuel oil, the bypass valve adapted to bypass oil past the oil regulator during the start up of the burner and operating in the event of premature opening of the oil regulator by the electrical control preventing premature output of oil, and wherein the valve bypass closes when the pump reaches a predetermined speed, and wherein the electrical control allows the regulating valve assembly to open after a predetermined time, the oil regulator staying closed until the pump reaches the predetermined speed and the predetermined time has elapsed.

11. The fuel oil supply circuit of claim 10, further comprising a fuel supply passage between the oil pump and the regulator and a restricting valve interposed along the fuel supply passage dividing the fuel supply passage into upstream and downstream passages, the restricting valve adapted to provide a pressure drop from the upstream passage to the downstream passage, wherein the valve bypass is a diaphragm valve having one side subjected to the upstream passage and a second side subject to the downstream passage.

12. The fuel oil supply circuit of claim 10, wherein the diaphragm valve has an open position at startup in which fuel oil is recirculated to a fuel supply and a closed position preventing recirculation of fuel oil through the diaphragm valve, wherein the diaphragm valve includes a spring tending to keep the diaphragm valve open.

13. The fuel oil supply circuit of claim 10 wherein the electrical control is a solenoid valve.

14. The fuel oil supply circuit of claim 13 further comprising means for switching the solenoid valve between states after a predetermined time at startup of the burner.

15. The fuel oil supply circuit of claim 13 wherein the oil regulator comprises a piston and a spring, the spring acting on the piston tending to keep the oil regulator closed, the oil regulator adapted to open an outlet port leading to the nozzle via pressurized fuel oil acting upon a face of the piston against the action of the spring, the oil regulator having an excess fuel port recirculating fuel oil to a fuel oil supply for the pump, the piston adapted to open the excess fuel port when excess fuel oil is supplied to the oil regulator.

16. The fuel oil supply circuit of claim 15 wherein the solenoid valve controls fuel oil flow through a bypass port in the oil regulator, the bypass port recirculating fuel oil to the fuel oil supply for the pump, sufficient fuel oil flowing through the bypass port to relieve pressure in the oil regulator and keep the piston closed over the outlet port.

17. The fuel oil supply circuit of claim 15 wherein the solenoid valve blocks flow through a second outlet port between said first outlet port and the nozzle during startup of the burner, and intermediate passage connecting the first and second outlet ports.

18. The fuel oil supply circuit of claim 10 wherein the electrical control and the valve bypass each independently prevent smoking and soot production in the combustion chamber of the burner upon startup of the burner.

* * * * *